US005161746A

United States Patent [19]

Bliss

[11] Patent Number: 5,161,746

[45] Date of Patent: Nov. 10, 1992

[54] REVERSIBLE HAMMERMILL

[76] Inventor: William L. Bliss, R.R. #1, Box 232, Newkirk, Okla. 74647

[21] Appl. No.: 672,532

[22] Filed: Mar. 20, 1991

[51] Int. Cl.[5] ..... B02C 13/12

[52] U.S. Cl. ..... 241/189.2; 241/197

[58] Field of Search ..... 241/189 A, 190, 197

[56] References Cited

U.S. PATENT DOCUMENTS

| | | | |
|---|---|---|---|
| Re. 23,468 | 3/1952 | Wilson | 241/186.3 |
| 2,482,279 | 9/1949 | Lemmon et al. | 241/186.3 |
| 2,767,928 | 10/1956 | Hanse et al. | 241/186 |
| 3,083,921 | 4/1963 | Danyluke et al. | 241/186.3 |
| 3,088,683 | 5/1963 | Joseph et al. | 241/186.2 |
| 3,805,660 | 4/1974 | Burrough | 241/197 |
| 3,915,397 | 10/1975 | Olson | 241/186.3 |
| 4,009,836 | 3/1977 | Strom et al. | 241/73 |
| 4,350,307 | 9/1982 | Olson | 241/186.3 |
| 4,720,051 | 1/1988 | Graveman | 241/189 |

FOREIGN PATENT DOCUMENTS

| | | | |
|---|---|---|---|
| 0694209 | 10/1979 | U.S.S.R. | 241/189 A |

*Primary Examiner*—Mark Rosenbaum
*Assistant Examiner*—John M. Husar

[57] ABSTRACT

An improvement to a hammermill extends the life of the hammers by providing regular and periodic reversal of the rotor of the hammermill without the necessity of disassembly of the hammermill or the necessity of moving or operating levers, screws or other devices in order to reposition the internal apparatus so that the mill can be reversed.

The improvement consists of an internal apparatus attached to the hammermill at the inlet to the hammermill. The internal apparatus is formed of a vertical plate extending adjacent the inlet and attached to a mounting plate. The mounting plate is bolted to the hammermill. The vertical plate extends across the width of the hammermill. A plurality of triangular reenforcement plates are welded between the vertical plate and the mounting plate. The mounting plate can have its free edge bent toward the inner wall of the hammermill to insure a tight seal with the inner wall. Hard-facing can be formed along the exposed end of the vertically extending plate and the free edge of the mounting plate to substantially extend the life of the assembly. Two such assemblies are mounted inside the hammermill, one on each side of the inlet and extending across the width of the mill.

5 Claims, 1 Drawing Sheet

REVERSIBLE HAMMERMILL

BACKGROUND OF THE INVENTION

Hammermills tend to have their capacity reduced as material is fed into their input. Also the hammers on the mills tend to stress harden as they rotate in one direction. One of the cures for the above problems is to periodically reverse the hammermill. Such reversal will unplug the mill if it is plugged. The reversal will also cause the stress on the hammers to be transferred to the opposite side of the hammers. Such reversal of stress on the hammers will increase their service life more than double the service life if the hammers are not reversed.

One of the problems with reversing the hammermill rotor is the modification of the air control equipment mounted inside of the mill. Most air control equipment is either removed and remounted on the opposite side of the mill, or it is swung over to the other side using pivots and levers to accomplish the transfer.

The hammermills with the movable type air control equipment are illustrated in U.S. Pat. No. 2,482,279 issued to A. W. Lemmon et al, which has a first inlet deflector 55 which is reversible to either side of the inlet, depending on the direction of the rotor. Deflector 55 co-operates with 80 to accomplish the direction change. U.S. Pat. No. 3,083,921 issued to O. Danyluke et al, has a pair of members 30 mounted in the bottom of the mill to act as dust deflectors, along with a pair of breaker blocks 24 each of which must be adjusted for proper operation.

U.S. Pat. No. 4,350,307 issued to Gerald R. Olson illustrates a deflecting apparatus mounted in the inlet to attempt to control the flow of air. The device, however, must be moved each time the rotor is changed in direction. Reissue U.S. Pat. No. 23,468 issued to J. G. Wilson is like the Olson patent in that a member 30 must be changed each time the rotor is reversed.

U.S. Pat. No. 3,915,397 is the closest to the subject mater of this invention but does not solve the problem of reversing the mill rotor since the plate 50 must be detached and reattached each time the rotor is reversed. The plate also restricts the inlet thus limiting the amount of material that can be handled by the mill at any one time.

SUMMARY OF THE INVENTION

This invention describes the installation of a pair of plates at the inlet to a hammermill. The plates create a decrease in pressure at the inlet and simultaneously cause an additional breaking of material when the material is trapped by the rotating hammers. When the material is fed into the inlet, most of the material is pulverized by the hammers, however some of the fine material will continue to rotate about the axis of the rotor of the hammermill and not pass out of the outlet. Such action tends to reduce the capacity of the mill after a period of time. The above situation can be substantially improved by reversing the rotor and by modifying the air pressure inside of the hammermill.

This invention provides solutions to all of the above problems by mounting a "v" shaped plate assembly at the opening to the hammermill. The wall of the plate assembly adjacent the inlet opening is vertical thereby not restricting the inlet flow of material. The assembly further has an open pocket to trap circulating air just prior to the inlet causing a reduction in air pressure at the inlet. The open pocket tends to disrupt the material trapped in the rotor, thus improving the throughput of the mill. With an assembly mounted on each side of the mill, the rotor can be reversed without the necessity of any adjustments, remountings, or other modifications to the mill. Such ease in reversal will result in a mill being reversed on a frequent basis, thereby substantially increasing not only the life of the hammers, but also increasing the throughput of the mill.

DETAILED DESCRIPTION OF THE INVENTION

Figure 1:
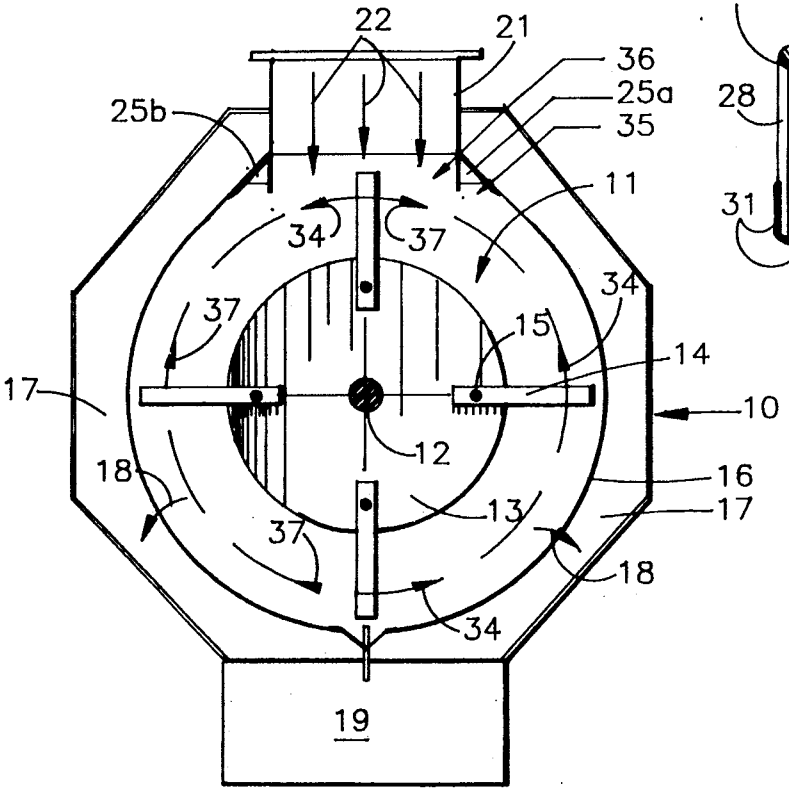
FIG. 1 is a side view of a hammermill illustrating the attachment of the "v" shaped plate assembly; and, FIG. 2 is a cut-away perspective view of the "v" plate assembly.

Referring to all of the figures but in particular to FIG. 1, a hammermill generally referred to by arrow 10 has a rotor generally referred to by arrow 11 attached rigidly to a shaft 12. Shaft 12 is journaled in bearings which are not illustrated and is attached to a motor also not illustrated. Rotor 11 is made of a plurality of concentric discs 13 which are spaced along shaft 12. A plurality of hammers 14 are pivotally attached to disc 13 by means of pins 15 which allow hammer 14 to swing about pin 15 when hammer 14 strikes an object. Such construction is well known to any person skilled in the art and will not be further discussed in detail.

As hammers 14 rotate and strike an object, a high impact stress is placed on not only hammers 14, particularly at the attachment point at pin 15 but also to rotor 11. Stress fractures will develop rather quickly if the mill rotor 11 is not reversed quite often. As discussed in the prior art, however, reversal of a mill was not an easy task, therefor, the mills tended not to be reversed often enough to prevent premature stress failure of rotor 11 and hammers 14.

Mill 10 generally includes a screen 16 for determining the maximum size of the material passing through the screen and to the outside area 17 as indicated by arrows 18. The material then drops to a collection area 19 where it is removed in any usual manner such as a conveyor. The outside area is defined by an outer wall 20 which may be removable for cleaning and maintaining of the mill. An inlet 21 is a walled tube, either circular or rectangular in crossection. The material is generally dropped into inlet 21 along the direction of arrows 22 where it is impacted by hammers 14 and pulverized in the usual manner.

Figure 2:
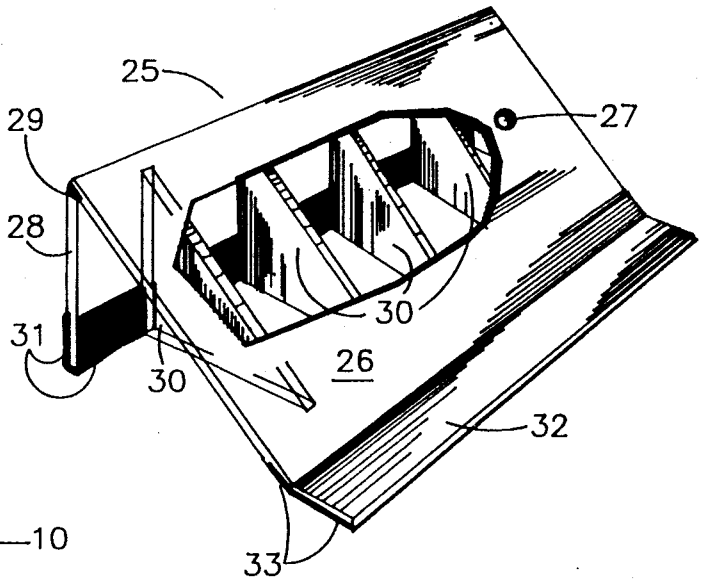

In order to prevent jamming or plugging of the inlet 21 or rotor 11 by material that is trapped between hammers 14 and discs 13, a unique air control apparatus **25*a* and 25*b* is provided. Each of the air control apparatus 25 is illustrated in FIG. 2 in detail. Referring to FIG. 2, the air control device comprises a mounting plate 26 which includes a plurality of spaced holes 27, one of which is illustrated. An impact and deflector plate 28 is attached at one edge to mounting plate 26 by any usual means such as welding at 29. A plurality of triangular braces 30 are welded between plates 26 and 30, and are used primarily for making the assembly rigid. Along the inside, bottom and outside of a portion of plate 28 is added wear areas 31 to protect plate 28 from extreme erosion as it is impacted by swiftly moving material. A third plate 32 is attached along its edge and at an angle with mounting plate 26. Plate 32 seals the mounting plate against the wall 16 of mill 10. Since it is likewise subject to extreme impacting by the material as it moves around the inside of mill 10, wear resistant metal is added to the under surface of not only plate 32 but the attached portion of plate 28. The entire assembly is attached in the position illustrated as 25***a* and 25*b* of FIG. 1. It is important that impact and deflection plate 28 be vertical with the wall of inlet 21 in order not to restrict the movement of material into inlet 21. It is not necessary that plate 28 be flush with the wall of inlet 21.

OPERATION

The hammermill illustrated in FIG. 1 operates in the following manner. Shaft 12 is rotated at a high rotational velocity causing discs 13 which carry pins 15 to rotate the hammers 14 in a direction, for example, as illustrated by arrow 34. Such rotation will cause hammers 14 to rotate at a high velocity past plate 28 (see FIG. 2). This high velocity will cause an increase in pressure at location 35 and a corresponding decrease in pressure at location 36. Such increase in pressure will disrupt the flow of the material out of rotor 11 where the material can be impacted by deflector plate 28. An decrease in pressure at location 36 will pull the material falling into inlet 21 in the direction of arrow 22 toward rotor 11 where the material will be impacted by hammers 14. After a period of time the rotor can be stopped and reversed without any other changes, adjustments, removals or reattachments being necessary before the rotor can be restarted in the opposite direction in the direction of arrows 37, for example. When the reversal is accomplished with such ease, the reversal can be programmed by a computer, timed control equipment, or manually. Impact and deflector plates 25 can be easily maintained or replaced when the need arises.

CONCLUSIONS

A substantially improved hammermill which substantially increases the service life of the mill hammers, has been disclosed, that permits reversal of the rotor at will without the necessity for stopping the mill and making changes, modifications, remounting or other adjustments to the internal workings of the mill prior to starting the rotor again. This invention not only improves the throughput of the mill, but also eliminates the down time used for transferring the internal equipment to the other side of the mill in order to properly operate the mill in the reverse direction.

The invention also improves the throughput of the mill by removing the recirculating material trapped in the rotor, by creating a decrease in pressure at the inlet thereby causing the material to by sucked in to the inlet as well as entering by gravity. The invention also improves the throughput of the mill by maintaining a large opening for the material to enter, which opening is unrestricted by any flow control equipment mounted inside the inlet of the mill.

It is obvious that changes, modifications and alterations can be made in this invention and still be within the spirit and scope of the invention as set out in the specification and appended claims.

What I claim is:

1. In a hammermill having a rotor mounted on a shaft with a reversible motor connected to said shaft; a plurality of hammers spaced around said rotor; pivot means for attaching said hammers to said rotor said hammers having a mounting end and a tip opposite said mounting end; housing means having a top and a width, for enclosing said rotor and hammers; and a vertical inlet means mounted at the top of said housing means and extending through said housing means; an improved apparatus for permitting the reversal of said rotor on a periodic basis comprising an insertplate assembly having:

a. a first and second substantially vertical plate rigidly mounted inside of said housing adjacent said vertical inlet means, each of said vertical plates extending from said housing to a location to but clearing the tips of said hammers and extending the width of said housing; and, b. first and second plate mounting means rigidly attached to said first and second substantially vertical plates respectively along their length and including means for rigidly attaching said late mounting means to said housing;

whereby as said rotor turns in one direction, an increase in air pressure is generated behind one of said vertical plates and an decrease in air pressure is generated at said inlet, and with reversal of said rotor, an increase in air pressure will be generated behind said second vertical plate causing a decrease in air pressure at said inlet, said plates providing a means for periodic reversal of said rotor thereby extending the life of said hammers.

2. Apparatus as claimed in claim 1 wherein said substantially vertical plate has an upper edge adjacent said housing and a lower edge, and wherein said lower edge is hard-faced.

3. Apparatus as claimed in claim 1 wherein said plate mounting means has one edge attached to said substantially vertical plate and a free edge, and wherein said free edge and the surface of said plate mounting means adjacent said free edge is hard-faced.

4. Apparatus as claimed in claim 3 wherein said free edge is formed from said plate mounting means by bending said plate mounting means at an angle along an edge of said plate mounting means which is opposite said edge rigidly attached to said substantially vertical plate.

5. Apparatus as claimed in claim 3 wherein a plurality of triangular reenforcement plates are attached between each of said substantially vertical plates and its corresponding plate mounting means.

* * * * *